US010054410B2

(12) United States Patent
Menefee, III

(10) Patent No.: US 10,054,410 B2
(45) **Date of Patent: *Aug. 21, 2018**

(54) CARTRIDGE FOR HANDHELD PAYLOAD LAUNCHER SYSTEM

(71) Applicant: James Y. Menefee, III, Macon, GA (US)

(72) Inventor: James Y. Menefee, III, Macon, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/198,847

(22) Filed: Jun. 30, 2016

(65) Prior Publication Data

US 2017/0030666 A1 Feb. 2, 2017

Related U.S. Application Data

(63) Continuation-in-part of application No. 13/566,200, filed on Aug. 3, 2012, now Pat. No. 9,383,161.

(Continued)

(51) Int. Cl.
*F42B 7/12* (2006.01)
*F42B 5/26* (2006.01)

(Continued)

(52) U.S. Cl.
CPC ..... *F42B 7/12* (2013.01); *F41C 3/02* (2013.01); *F41F 1/00* (2013.01); *F42B 5/26* (2013.01);

(Continued)

(58) Field of Classification Search
CPC .. F41A 21/40; F41A 21/42; F42B 8/12; F42B 8/24; F42B 5/26; F42B 5/30; F42B 5/28; F42B 5/285; F42B 5/307; F42B 7/12; F42B 7/00; F42B 7/02; F42B 7/043; F42B 7/06; F42B 7/08; F42B 30/003; F42B 33/12

(Continued)

(56) References Cited

U.S. PATENT DOCUMENTS 83,434 A * 10/1868 Abraham, et al. ..... F42B 5/26 102/469
161,514 A * 3/1875 Hunting ..... F42B 5/26 102/469

(Continued)

FOREIGN PATENT DOCUMENTS

CN 1061658 A 6/1992
DE 365573 C 12/1922

(Continued)

OTHER PUBLICATIONS

Extended European Search Report issued in Application No. 17153642.8, dated Nov. 16, 2017 (14 pages).

(Continued)

*Primary Examiner* — Derrick R Morgan
(74) *Attorney, Agent, or Firm* — Eversheds Sutherland

(57) ABSTRACT

This disclosure relates to self-contained cartridges and launcher systems for discharging or launching payloads to downrange targets, and methods of attenuating or offsetting recoil when activating such cartridges. Examples of payloads that can be deployed with the disclosed launcher apparatus include chemical, biological, pyrotechnic, marker, tracer, signaling, non-lethal, explosive, smoke, and similar payloads.

22 Claims, 8 Drawing Sheets

Related U.S. Application Data

(60) Provisional application No. 61/515,097, filed on Aug. 4, 2011.

(51) Int. Cl.

| | |
|---|---|
| ***F41C 3/02*** | (2006.01) |
| ***F41F 1/00*** | (2006.01) |
| *F41A 21/40* | (2006.01) |
| *F41A 19/13* | (2006.01) |
| *F41A 17/64* | (2006.01) |
| *F41C 9/08* | (2006.01) |

(52) U.S. Cl.
CPC ..... *F41A 17/64* (2013.01); *F41A 19/13* (2013.01); *F41A 21/40* (2013.01); *F41C 9/08* (2013.01)

(58) Field of Classification Search
USPC ..... 102/452, 456, 457, 462, 463
See application file for complete search history.

(56) References Cited

U.S. PATENT DOCUMENTS 226,167 A * 4/1880 Gardner ..... F42B 5/26 102/464
985,171 A 2/1911 Hermsdorf
1,196,200 A * 8/1916 Batcher ..... F42B 5/28 102/462
1,565,036 A 12/1925 Tank
1,788,443 A 1/1931 Sedgley
2,042,934 A 6/1936 Gill
2,073,416 A 3/1937 Finzi
2,444,920 A 7/1948 Davis, Jr. et al.
2,519,123 A 8/1950 Dwyer et al.
2,541,025 A 2/1951 Bluford et al.
2,582,124 A * 1/1952 Holmes ..... F42B 7/04 102/461
2,651,972 A 9/1953 Engelke
2,789,471 A 4/1957 Bluford et al.
2,880,543 A 4/1959 Frantzius
2,889,653 A 6/1959 Clauser et al.
2,889,747 A 6/1959 Kamp et al.
2,949,061 A 8/1960 Benditt et al.
2,970,519 A 2/1961 Musser et al.
2,970,520 A 2/1961 Grandy
3,008,378 A 11/1961 Musser
3,008,412 A 11/1961 Merdinyan
3,026,775 A 3/1962 Musser
3,027,809 A 4/1962 Musser
3,034,433 A * 5/1962 Gronn ..... F42B 5/295 102/464
3,055,301 A * 9/1962 Miller ..... F42B 7/04 102/449
3,092,026 A * 6/1963 Williams ..... F42B 7/04 102/455
3,144,808 A 8/1964 Stapp et al.
3,162,124 A * 12/1964 Miller ..... F42B 5/30 102/449
3,188,956 A * 6/1965 Hellis ..... F42B 7/06 102/461
3,352,238 A 11/1967 Spragg et al.
3,443,333 A 5/1969 Manatos
3,517,617 A * 6/1970 Hall ..... F42B 7/12 102/461
3,575,113 A 4/1971 Ashbrook et al.
3,609,904 A * 10/1971 Scanlon ..... F41A 15/04 102/466
3,611,935 A 10/1971 Beckes et al.
3,619,930 A 11/1971 Beerman et al.
3,628,225 A * 12/1971 Parker ..... B29C 57/10 102/530
3,630,151 A 12/1971 Rakowsky
3,678,858 A * 7/1972 Herter ..... F42B 7/12 102/463
3,705,552 A 12/1972 Lerman
3,721,194 A 3/1973 Weston, Jr.
3,728,809 A 4/1973 Mulich et al.
3,855,930 A 12/1974 Mulich et al.
3,931,726 A 1/1976 Grubb
3,960,052 A 6/1976 Smith et al.
3,980,139 A 9/1976 Kirk
4,010,688 A 3/1977 Smith et al.
4,083,138 A * 4/1978 Cash ..... F41C 3/00 102/501
4,091,709 A 5/1978 Spurk
4,141,275 A 2/1979 Hollingsworth et al.
4,162,645 A * 7/1979 Abbott ..... F42B 8/04 86/23
4,176,606 A 12/1979 King et al.
4,192,236 A 3/1980 Scott
4,268,987 A 5/1981 Cash
4,411,086 A 10/1983 Christopherson
4,457,233 A 7/1984 Hyde
4,473,964 A 10/1984 Straub et al.
4,553,481 A 11/1985 Ricci
4,644,930 A 2/1987 Mainhardt
4,681,038 A * 7/1987 Washburn ..... F42B 5/26 102/430
4,682,952 A 7/1987 Forsman
4,689,912 A 9/1987 Gillum
4,753,152 A 6/1988 Baechler
4,964,469 A 10/1990 Smith
5,085,147 A 2/1992 Gold et al.
5,105,569 A 4/1992 Straitiff
5,171,934 A 12/1992 Moore
5,233,774 A 8/1993 Leibowitz
5,299,502 A * 4/1994 Maki ..... F42B 7/08 102/449
5,363,769 A * 11/1994 Bellak ..... F42B 7/02 102/446
5,388,361 A 2/1995 Farr
5,413,050 A * 5/1995 Maki ..... F42B 7/043 102/449
5,429,034 A 7/1995 Badali et al.
5,631,441 A 5/1997 Briere et al.
5,635,667 A 6/1997 Boyer et al.
5,783,768 A 7/1998 Jacobson
5,894,891 A 4/1999 Rosenstock et al.
5,937,556 A 8/1999 Daily et al.
6,012,531 A 1/2000 Ryan
6,145,440 A 11/2000 Franzen
6,164,209 A 12/2000 Best et al.
6,283,037 B1 * 9/2001 Sclafani ..... F42B 12/40 102/444
6,393,992 B1 5/2002 Vasel et al.
6,470,805 B1 10/2002 Woodall et al.
6,487,972 B1 12/2002 Cook et al.
6,725,941 B2 4/2004 Edwards
6,931,993 B1 * 8/2005 Manole ..... F42B 12/38 102/458
RE38,792 E 9/2005 Ishihara et al.
7,325,350 B1 2/2008 Grimes
7,415,929 B1 * 8/2008 Faughn ..... F42B 7/08 102/448
7,478,680 B2 1/2009 Sridharan et al.
7,752,974 B2 7/2010 Wenaas et al.
7,814,820 B2 10/2010 Menefee
7,877,917 B2 2/2011 Cinciu
8,408,134 B2 4/2013 Sibum
8,485,100 B2 * 7/2013 Lee ..... F42B 5/073 102/430
8,511,231 B2 8/2013 Hayes et al.
8,807,004 B1 8/2014 Menefee, III
9,383,161 B2 * 7/2016 Menefee, III ..... F41C 3/02
2003/0010185 A1 1/2003 O'Dwyer
2003/0167953 A1 9/2003 Teilhol et al.
2006/0169165 A1 8/2006 Bruun
2007/0006506 A1 * 1/2007 Lan ..... F41H 9/10 42/1.08

(56) References Cited

U.S. PATENT DOCUMENTS

| | | | | |
|---|---|---|---|---|
| 2007/0012213 | A1* | 1/2007 | Sheaffer | F42B 7/08 102/457 |
| 2007/0107588 | A1* | 5/2007 | Menefee | F42B 7/02 86/25 |
| 2008/0178508 | A1 | 7/2008 | Cinciu | |
| 2010/0192439 | A1 | 8/2010 | Murello | |
| 2011/0017090 | A1* | 1/2011 | Menefee, III | F42B 7/02 102/448 |
| 2013/0031819 | A1* | 2/2013 | Menefee, III | F41C 3/02 42/2 |
| 2013/0042783 | A1* | 2/2013 | Diller | F42B 7/04 102/513 |
| 2017/0030666 | A1* | 2/2017 | Menefee, III | F41F 1/00 |

FOREIGN PATENT DOCUMENTS

| | | | |
|---|---|---|---|
| DE | 29707924 | U1 | 7/1997 |
| EP | 0923700 | B1 | 2/2003 |
| FR | 2377018 | A1 | 8/1978 |
| GB | 2149483 | A | 6/1985 |
| RU | 2103627 | C1 | 1/1998 |
| RU | 2170405 | C1 | 7/2001 |
| WO | 1998/055820 | A1 | 12/1998 |
| WO | 2006/101410 | A1 | 9/2006 |
| WO | 2011/085751 | A1 | 7/2011 |
| WO | 2011/142695 | A1 | 11/2011 |

OTHER PUBLICATIONS

European Rule 94(3) Communication for Application No. EP 12748313.9, dated Jun. 25, 2015 (7 pages).

International Preliminary Report on Patentability for International Application No. PCT/US2012/049471, dated Feb. 4, 2014 (12 pages).

Annex to Form PCT/ISA/206, Communication Relating to the Results of the Partial International Search for PCT/US2012/049471, dated Nov. 5, 2012 (2 pages).

Field Manual No. 3-23.30, "Grenades and Pyrotechnic Signals," Chap. 4, Pyrotechnic Signals & Simulators, pp. 4-1-4-24, Headquarters, Dept. of the Army, Wash., DC, Oct. 5, 2009.

* cited by examiner

CARTRIDGE FOR HANDHELD PAYLOAD LAUNCHER SYSTEM

CROSS REFERENCE TO RELATED APPLICATIONS

This application is a continuation-in-part of U.S. patent application Ser. No. 13/566,200, filed Aug. 3, 2012, now U.S. Pat. No. 9,383,161, which claims the benefit of U.S. Provisional Application No. 61/515,097, filed Aug. 4, 2011, the disclosures of which are incorporated herein by reference in their entireties.

TECHNICAL FIELD OF THE INVENTION

This disclosure relates to systems for discharging payloads, including chemical payloads, to downrange targets.

BACKGROUND OF THE INVENTION

Cartridge systems that contain a particular payload to be launched constitute extremely practical constructions for deploying almost any material or projectile downrange. Typical cartridge systems incorporate the desired payload, a propellant, and some priming composition all within a self-contained unit. While ammunition cartridges are prototypical of cartridge devices, useful cartridge systems have been designed to launch other payloads, such as chemical, pyrotechnic, marker, tracer, signaling, non-lethal projectiles, explosive, smoke, and the like, to exploit their specific functions.

Most cartridge systems require specialized launching devices that are designed for use with that particular cartridge, for example, specialized 37 mm and 40 mm munitions launchers are needed for dispatching payloads such as rubber balls or chemicals. However, the weight, portability, and ease of operation of many launching devices could be improved. These features can be important factors in the decision to carry such launchers into hazardous situations, where it is usually extremely difficult to bring traditional tools into action. For example, extremely dangerous combat or battlefield situations, law enforcement operations, and riots, constitute dangerous environments in which portability and ease of operation of a chemical, fire suppression, signaling, and related cartridges and launchers may be important. Moreover, hand carried or handheld launching devices and their cartridges are limited in size due to one's ability to handle recoil, thereby limiting the overall amount of any particular payload that can be safely and accurately deployed.

Therefore, it would be helpful to discover and develop new launchers and systems for discharging payloads such as chemical payloads to downrange targets, including targets at close ranges. While such payload launchers could be hand carried, for example, handheld, shoulder-mounted, or otherwise unsecured to a platform, what are needed are launcher systems that can be carried by an individual, readily deployed and easily used under combat or riot conditions, and with some means of managing recoil when launching any specialized payload downrange.

SUMMARY OF THE INVENTION

This disclosure relates to launchers and launcher systems for discharging or deploying payloads such as chemical payloads to downrange targets, including those at close ranges, and the methods of using launcher systems for deploying payloads to the desired target. These devices and methods include means for managing recoil when using the disclosed launcher systems. Examples of payloads that can be launched with the disclosed system include chemical, biological, pyrotechnic, marker, tracer, signaling, non-lethal projectile, explosive, smoke, and the like. The device and method are not limited to any particular cartridge design or payload. Thus, the device and method can be used with separate cartridges, integral cartridge components, multi-cartridge or multi-component cartridge embodiments, and any other type cartridge system. Features of the launcher systems include their ability to be carried by an individual and typically handheld, and incorporating a means of managing recoil when launching any payload. While not intending to be limiting, preferred uses of the disclosed launcher system include launching a chemical payload at close range such as used for fire suppression, or deploying a heat barrier, or launching a chemical payload at close range directly at personnel, with the intent to cover the individual with a fire suppression or anti-chemical warfare substance. Thus, a wide range of cartridge arrangements and muzzle velocities are useful with this device.

Thus, in one aspect, this disclosure provide a payload launcher system comprising:

a) a launcher tube having an open nozzle end and an aft end;

b) a cap removably-attached to the aft end, the cap comprising a firing pin opening and a forward- and rearward-movable firing pin, wherein the firing pin protrudes through the firing pin opening in its forward-most position; and c) a chamber within the launcher tube adjacent the firing pin opening, the chamber adapted for receiving at least one self-contained cartridge or cartridge components, wherein the self-contained cartridge or cartridge components comprise(s) a primer and a payload, and wherein the primer is positioned within the chamber adjacent the firing pin opening.

According to a further aspect, this disclosure provides a method of launching a payload, the method comprising:

a) providing a payload launcher system, the payload launcher system comprising:

i) a launcher tube having an open nozzle end and an aft end;

ii) a cap removably-attached to the aft end, the cap comprising a firing pin opening and a forward- and rearward-movable firing pin, wherein the firing pin protrudes through the firing pin opening in its forward-most position; and iii) a chamber within the launcher tube adjacent the firing pin opening, the chamber adapted for receiving at least one self-contained cartridge or cartridge components, wherein the self-contained cartridge or cartridge components comprise(s) a primer and a payload, and wherein the primer is positioned within the chamber adjacent the firing pin opening;

and b) striking the firing pin with or on any object with sufficient force to ignite the primer and to offset at least a portion of the recoil resulting from launching the payload.

This disclosure further provides for a self-contained cartridge comprising:

a) a cartridge case having a forward end and an aft end, wherein the forward end has a closed configuration and an open configuration;

b) a primer situated at the aft end of the cartridge case;

c) a propellant adjacent the primer; and d) a payload;

wherein the open configuration comprises a tapered nozzle formed when the cartridge opens during launching of the payload, and the diameter of the nozzle opening is less than the inner diameter of the cartridge case.

According to another aspect, this disclosure provides for a self-contained cartridge comprising:

a) a cartridge case having a forward end and an aft end, wherein the forward end has a closed configuration and an open configuration and the closed configuration comprises a crimp or closure;

b) a primer situated at the aft end of the cartridge case; and c) a payload;

wherein the open configuration comprises a tapered nozzle formed when the cartridge opens during launching of the payload, and the diameter of the nozzle opening is less than the inner diameter of the cartridge case. In this aspect, the self-contained cartridge can optionally further comprise a propellant adjacent the primer.

These and other aspects and embodiments are provided in the detailed description and appended claims, and certain embodiments are illustrated in the figures.

DETAILED DESCRIPTION OF THE INVENTION

Figure 1A:
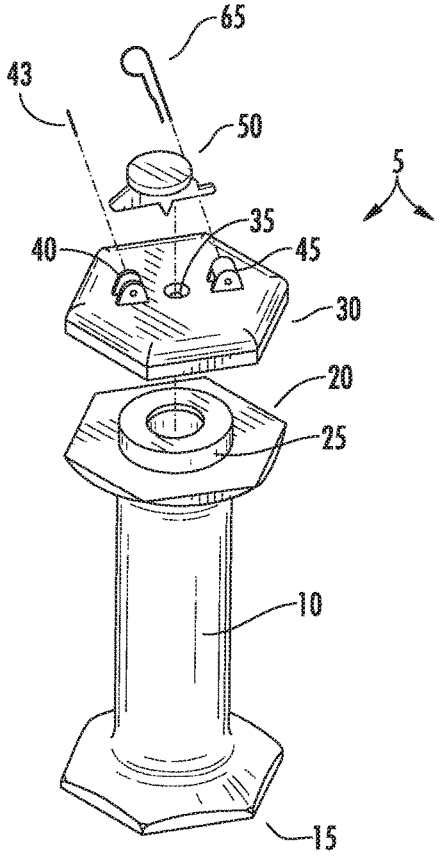
FIG. 1A illustrates an exploded view of a representative embodiment of the handheld payload launcher system according to this disclosure, illustrating the launcher tube, the cap, and the firing pin of this particular embodiment.

This disclosure relates to launchers and launcher systems for discharging various payloads to downrange targets, including those at close ranges, and the methods of using launcher systems for deploying the payloads to the desired target. These devices and methods include means for managing recoil when using the disclosed launcher systems, and the device and method are not limited to any particular cartridge design or particular payload. Thus, the device and method can be used with separate cartridges, integral cartridge components, multi-cartridge or multi-component cartridge embodiments, and any other type cartridge system.

In some aspects and embodiments, the launcher system can be used in combination with a separate self-contained cartridge that is adapted for use with the recoil-managed launcher, as described herein. In this aspect or embodiment, the cartridge itself can comprise the primer, propellant, the payload, and any ancillary components such as wad systems, in a single self-contained cartridge. In this embodiment, the launcher is capable of being re-loaded by the user immediately after its discharge, for sending additional payload or a different payload downrange. The launcher system is not limited to a particular payload type. For example, the payload can comprise or can be selected from chemical, powder, gel, fire suppression, pyrotechnic, marker, tracer, signaling, non-lethal projectile, frangible, antipersonnel, explosive, smoke, incendiary, biological, heat insulating, anti-chemical warfare, anti-biological warfare, liquid-containing, powder-containing, and gel-containing payloads. Many different types of self-contained cartridges can be used in the launcher, for example, a flare cartridge, a smoke cartridge, a smoke flare cartridge, a signaling device cartridge, a chemical cartridge, a biological cartridge, a distraction device cartridge, a pyrotechnic cartridge, an anti-personnel cartridge, a marking cartridge, an incendiary cartridge, a tracer cartridge, a non-lethal projectile cartridge, an anti-chemical warfare cartridge, or anti-biological warfare cartridge, and the like, can all be employed with the disclosed launcher. Similarly, when the pre-loaded launcher is pre-loaded, it can comprise or can be selected from these types of payloads and components.

In other aspects and embodiments, the launcher itself can be pre-loaded to include the primer, propellant, payload and any necessary ancillary components such as wad systems for launching the payload, without the requirement for a separate "hull" or cartridge case. In these latter embodiments, such launcher devices are typically pre-loaded at the factory to include these components. Thus, no separate cartridge unit is required, and the pre-loaded device does not require any other gun or launching mechanism to fire or discharge the payload. This pre-loaded embodiment of the launcher system would be desirable when, for example, a single-use or one-shot device in which the launcher housing is a disposable and can be discarded after use, or the launcher housing can be saved and reloaded, for example, at a field facility or at the factory.

In yet further aspects and embodiment, the launcher system can be constructed or loaded using any type of blank-type ("blank") cartridge for propulsion, which fit into a chamber or sub-chamber designed to accept such cartridges. In this aspect, for example, a separate payload 110 can be muzzle loaded into the payload sub-chamber 80 of the launcher system, with a primer 38 in the blank propulsion cartridge 125 at the aft or rearward end of the launcher in the propellant sub-chamber 75, and the payload at the muzzle or forward end of the launcher. These launcher systems use a first propellant cartridge that generates rapidly expanding propellant gases, in combination with a separate payload or projectile component, sometimes in cartridge form, that is distinct from the propellant cartridge. Because the necessary muzzle velocity of chemical, smoke, and other such payloads is typically low (for example, <300 ft/sec), a blank propulsion cartridge is typically sufficient, although a relatively small primary charge can be used if desired. If desired, these two-component or multi-component (primer-propellant component separate from payload component) launchers can be used with a so-called "wadless" or granular obturating medium 105 situated between the primer at the aft end and the payload at the muzzle end, such that propellant gases are effectively sealed upon igniting the propellant with the primer to launch the payload. For example, wadless technology can be advantageously used in this manner for launching dry chemicals such as those used for fire suppression and the like.

According to one aspect of this disclosure, the launcher system is designed to be carried by an individual, for example, hand carried or in some manner carried on a person. Embodiments include launcher systems that can fit into an adult hand for use, regardless of that type cartridge system used with the launcher. Because of the simple recoil-management method, the disclosed devices are capable of handling and launching larger payloads than if the device is simply handheld and the primer strike was triggered in the conventional fashion. Accordingly, this disclosure provides a handheld launcher device particularly suited for use in the dangerous environments of combat or law enforcement situations, due to the device's light weight, portability, and ease of operation. Particularly advantageous features of the launcher system include the ability to rapidly cover an area—including personnel within that area—with a chemical payload such as fire suppression chemicals, anti-chemical warfare substances, or anti-biological warfare substances.

Features of the disclosed launcher device include its ability to activate cartridges, without many of the conventional firearm components. For example, embodiments of the launcher system can be devoid of a conventional trigger or trigger mechanism, trigger spring, hammer, sear, locking block, barrel, magazine, recoil spring, gas tube, slide, frame, bolt, locking block, conventional receiver, cylinder, typical safety mechanism, ejector, conventional extractor, guide rod, spring housing, a rail, decocker, stock, and the like. Thus, because the firing mechanism is simple, many of these conventional components can be omitted. Moreover, the comparatively low muzzle velocities do not require the launch and cartridge to accommodate high pressures upon firing, and therefore, conventional locking block and barrel components are not required. However, some of these components that can be included in the launcher system, although not shown in the figures, include extractor mechanisms for removing a fired cartridge and the like. Such components can be incorporated in a conventional fashion, if desired.

Conventional firearms also do not incorporate a recoil mitigation or attenuation mechanism as the disclosed device. Because of the simple recoil-management method, the disclosed devices are capable of handling and launching larger payloads than if the primer strike was triggered in the conventional fashion in the same sized device. Accordingly, this disclosure provides for both a launcher system that can be small enough to be handheld and further provides a recoil attenuation means.

While not intending to be limited, embodiments of the device and method are described. The various aspects of the disclosed device are illustrated in the figures. In general terms, the payload launcher system 5 of this disclosure can include a launcher tube 10 having a nozzle end 15 and an aft end 20, the aft end of which can be threaded if desired with threads 25 or a twist-lock mechanism that match the threads or twist-lock feature on a cap 30. The end cap 30 comprises a firing pin opening 35 through which the tip of the firing pin will protrude to contact the primer when the firing pin 50 is struck. Cap 30 also includes a hinge 40 one on side of the opening 35 and a safety pin receptacle 45 on the opposite side of the opening 35. The firing pin 50 is moveably attached, for example as shown in the figures, rotatably attached, to the cap 30 at hinge 40 at the hinge portion 55 of the firing pin, for example, with a hinge pin 43 that secures the hinge portion 55 and hence the firing pin 50 to the cap at hinge 40. Situated on the opposite side of the hinge portion 55 of the firing pin 50 is the safety arm 60 of the firing pin, which is retained from forward motion by a safety pin 65 that extends through the safety pin receptacle 45 on the cap 30. For example, the safety pin 65 can be a cotter key type pin or similar "fire extinguisher" type pin that is sufficiently secure that it requires significant force to be extracted from its retention position.

Once the safety pin is extracted or "pulled", the firing pin can be struck with a solid object, including for example a hand, a pistol, or a brick, or alternatively, the firing pin of the device can be struck against a solid object, such as a wall, a post, or a vehicle, either of which drive the point of the firing pin to strike the primer. Regardless of whether the primer is situated in a self-contained cartridge, in a blank propulsion cartridge, or as part of a pre-loaded one-shot launcher, activation as disclosed herein also provides a means to achieve recoil management or recoil reduction. Thus, recoil is either at least partially offset by the momentum created when the entire unit is moved forward when struck with a hand, pistol butt, rock or other object as described, or recoil is at least partially offset by striking the aft end of the launcher against the substantially immovable object such as a wall or a vehicle. In some embodiments, the primer is associated with the blank cartridge located in the propellant sub-chamber. In this manner, the launcher will be activated to expend the desired payload from chamber to the selected target, and regardless of the cartridge design, recoil can be managed in this manner.

When a self-contained cartridge is used in the launcher, the chamber 70 can extend from the aft end the entire distance to the nozzle end. Optionally, there can be steps within the chamber if it is desired to secure or "headspace" the self-contained cartridge at its forward end. Typically, the chamber will incorporate a slightly larger diameter aft end, sufficient to accommodate a slightly larger diameter aft end of the self-contained cartridge, for example, shaped similarly to a shotshell. In this aspect, the chamber 70 does not require separate sub-chambers to accommodate a separate primer component and a separate payload component, because the self-contained cartridge comprises the primer, optional propellant, and payload. Alternatively, when it is desired to have a separate primer component and a separate payload component and not combine these into a single self-contained cartridge, the overall chamber typically comprises a first sub-chamber 75, sometimes termed a propellant sub-chamber, within the launcher tube adjacent the firing pin opening, and a second sub-chamber 80, sometimes termed a payload sub-chamber, within the launcher tube adjacent and forward of the propellant sub-chamber. The first sub-chamber 75 is shaped to receive a first self-contained cartridge comprising the primer, and the second sub-chamber 80 is shaped to receive a second self-contained cartridge comprising the payload.

Thus, in one aspect, when it is desired to have a separate primer component and a separate payload component, the propellant sub-chamber 75 and the payload sub-chamber 80 also can be separated by an obturating component, optionally in its own sub-chamber, separating the propellant and the payload. Suitable obturating components include the so-called "wadless" technology described in U.S. Pat. No. 7,814,820 and U.S. Pat. No. 8,276,519 by Menefee, both of which are incorporated herein by reference in their entireties. While not intended to be limiting, wadless technology may be useful in launching powders and gels and the like relatively short distances, such as in cartridge launcher designed for distributing powders rapidly indoors or generally within closed confines. Moreover, the obturating component systems can be used in can be used in self-contained cartridges to launch any of the disclosed payloads. For example, self-contained cartridges comprising a wadless obturating medium also can be used in launching powders and gels relatively short distances.

Now referring to the figures, specific embodiments and aspects of the disclosure will be illustrated. The figures are intended merely as illustrations and are not intended to be limiting.

Figure 1B:
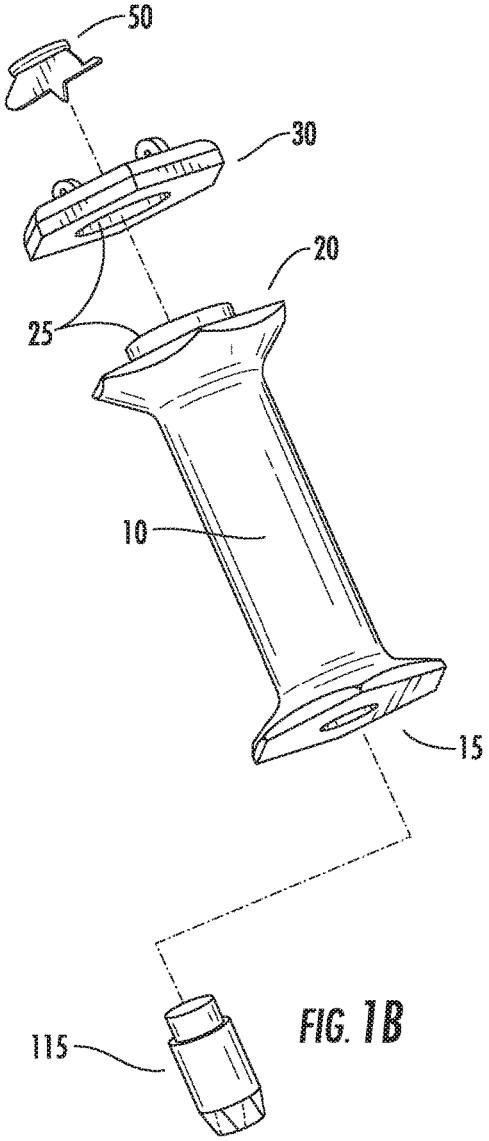
FIG. 1B illustrates an exploded view of a representative embodiment of the handheld payload launcher system according to this disclosure, illustrating the launcher tube, the cap, the firing pin, and nozzle feature of this particular embodiment

FIGS. 1A and 1B illustrate exploded views of a representative embodiment of a handheld payload launcher system 5 according to this disclosure. FIGS. 1A and 1B show the launcher tube 10 having a nozzle end 15 and an aft end 20, cap 30, and firing pin 50 portions, and their relative arrangement. An interchangeable or adjustable nozzle 115 is illustrated at the nozzle end 15. The locations of the threads 25 on the launcher tube 10 and cap 30 are illustrated. The firing pin 50, firing pin opening 35, a hinge 40, and safety pin receptacle 45 of cap 30 are also shown. This is a general exploded view of representative handheld payload launcher systems 5, particularly those that employ a blank-type cartridge that fits into a propellant sub-chamber 75 for propulsion, and which is used with a separate payload can be muzzle loaded, for example, into the payload sub-chamber 80 of the launcher system.

Figure 2A:
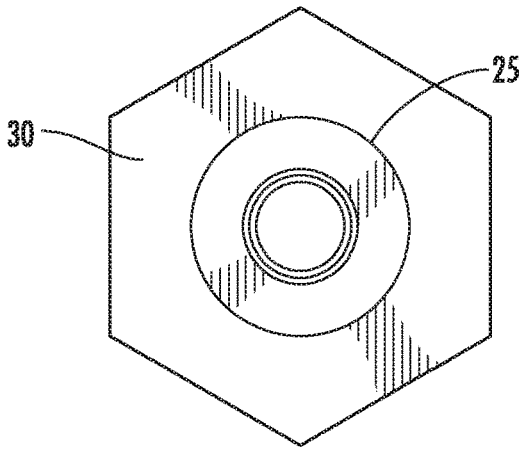
FIG. 2A illustrates a top view of a representative embodiment of a launcher tube of a handheld payload launcher system according to this disclosure, adapted to employ a blank-type cartridge that fits into a propellant sub-chamber.
Figure 2B:
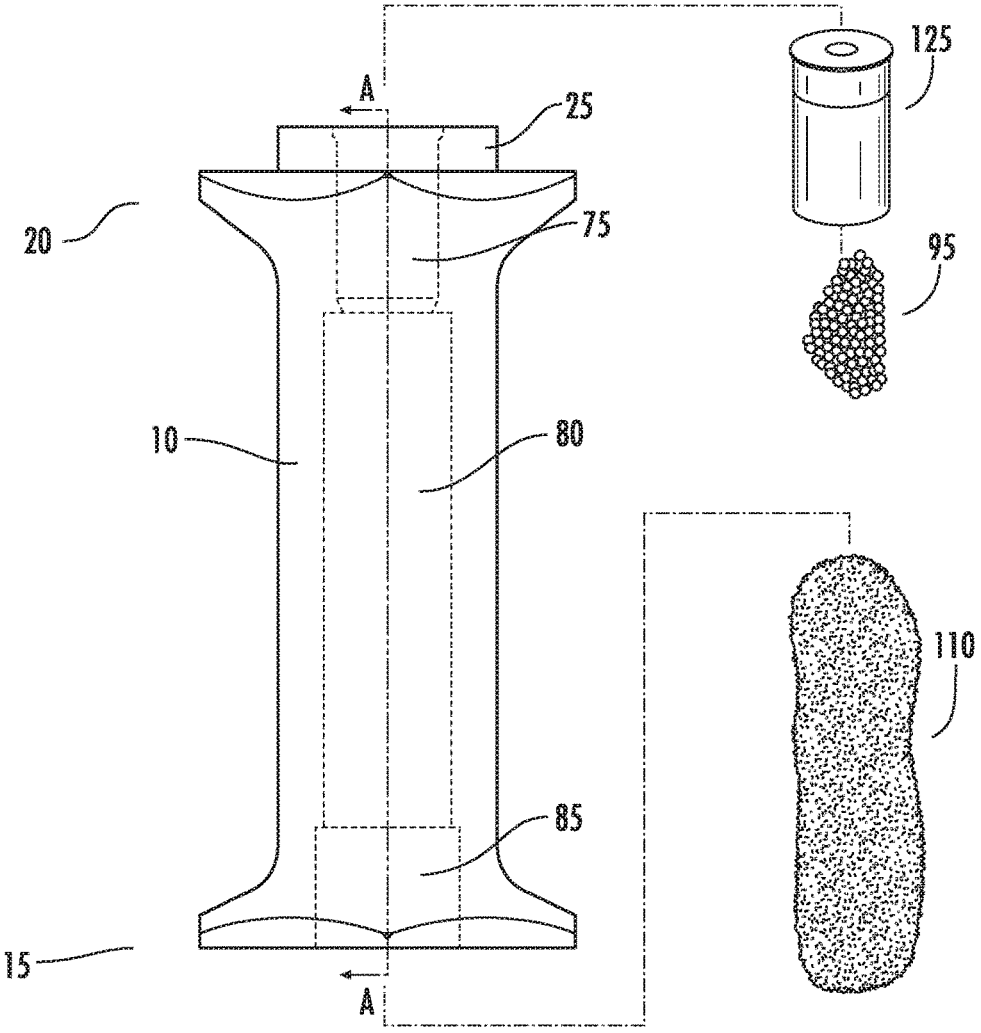
FIG. 2B illustrates a side view of the launcher tube illustrated in FIG. 2A. Also illustrated are the blank propulsion cartridge, the propellant, and the payload.

FIG. 2A illustrates a top view and FIG. 2B illustrates a side view of a representative embodiment of a launcher tube 10 of a handheld payload launcher system 5 according to this disclosure. In particular, FIGS. 2A and 2B show the launcher tube 10 designed to employ a blank-type cartridge that fits into a propellant sub-chamber 75 for propulsion, and which is used with a separate payload can be muzzle loaded, for example, into the payload sub-chamber 80 of the launcher system. Thus, FIGS. 2A and 2B correspond to the embodiment illustrated in FIGS. 1A and 1B. The view along the A-A direction of FIG. 2B is shown in the sectional view of FIG. 3A. The top view (FIG. 2A) of the launcher tube illustrates a design option of the handheld payload launcher system of this disclosure, that is, the flared portion of the aft and muzzle ends are polygonal shaped, which prevents the launcher system from rolling when it is placed on a surface. This illustrated feature is a design choice and is not a requirement of the launcher.

Figure 3A:
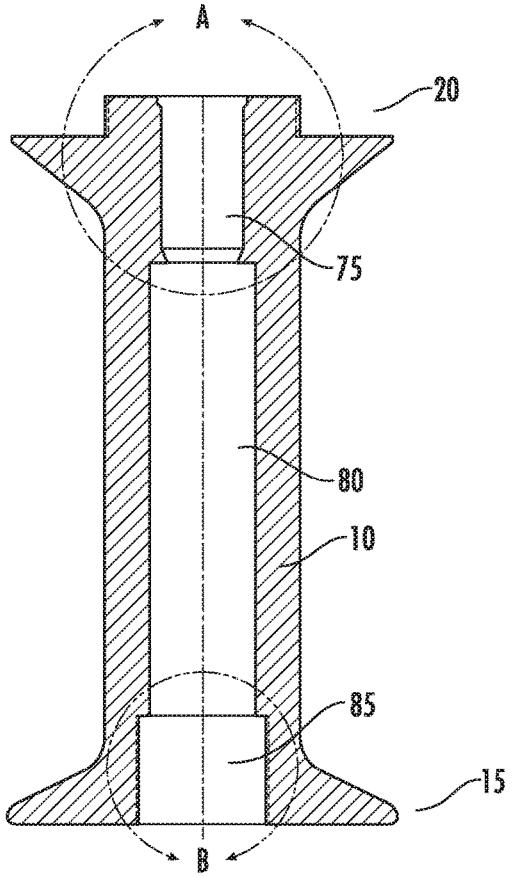
FIG. 3A illustrates a sectional view of a representative embodiment of a launcher tube of a handheld payload launcher system according to this disclosure, adapted to employ a blank-type cartridge that fits into a propellant sub-chamber.
Figure 3B:
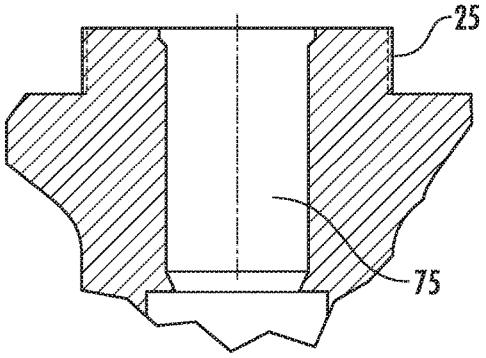
FIG. 3B illustrates an expanded view of the area marked "A" of the launcher tube illustrated in FIG. 3A.
Figure 3C:
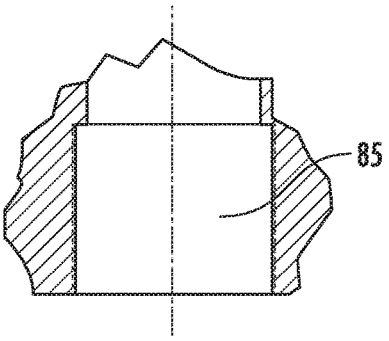
FIG. 3C illustrates an expanded view of the area marked "B" of the launcher tube illustrated in FIG. 3A.

FIGS. 3A-3C illustrate sectional views of a representative embodiment of a handheld payload launcher system 5 as disclosed herein, showing the launcher tube 10 with its various sub-chambers, including the propellant sub-chamber 75, the payload sub-chamber 80, and the nozzle receiving area 85. FIG. 3A is a sectional view of the launcher tube 10 of this embodiment, while FIG. 3B and FIG. 3C are detailed sectional views of the propellant sub-chamber 75, the payload sub-chamber 80, and the nozzle receiving area 85. Thus, the "A" and "B" detail areas shown in FIG. 3A are expanded in FIGS. 3B and 3C, respectively. The nozzle receiving area 85 illustrated at FIGS. 3A and 3C is merely illustrative of the fact that the nozzle receiving area itself can be shaped and sized in any way to achieve the desired pattern or dispersion of the payload, or the nozzle receiving area 85 can also include threads or other locking mechanism by which a separate nozzle, choke, or nozzle-like device can be attached. As in FIGS. 2A and 2B, FIGS. 3A-3C show the launcher tube 10 designed to employ a blank-type cartridge that fits into a propellant sub-chamber 75 for propulsion, and which is used with a separate payload can be muzzle loaded, for example, into the payload sub-chamber 80 of the launcher system. Thus, FIGS. 3A-3C correspond to the embodiments illustrated in FIGS. 1A-1B and FIGS. 2A-2B.

Figure 4A:
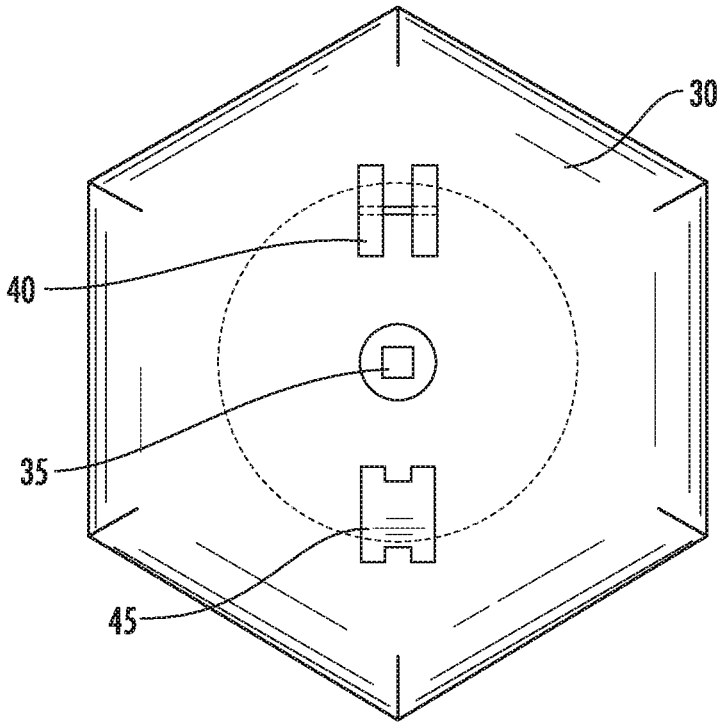
FIG. 4A illustrates a top view of a representative embodiment of an end cap adapted for use with a launcher tube of a handheld payload launcher system according to this disclosure.
Figure 4B:
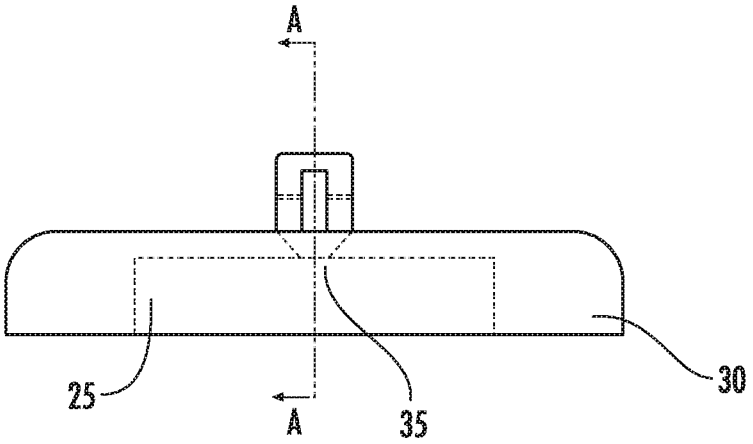
FIG. 4B illustrates a side view of the end cap illustrated in FIG. 4A.

FIGS. 4A and 4B illustrate a top view and a side view, respectively, of a representative aspect of a handheld payload launcher system 5, specifically showing the end cap 30. Cap 30 is shown to include a firing pin opening 35, a hinge 40 adapted to receive a hinge pin 43 (not shown), and a closed top safety pin receptacle 45 adapted to receive a safety pin 65, which secures the firing pin 50 (not shown in these figures) and prevents accidental firing of the launcher system. The cap 30 is adapted such that it can be united to the launcher tube, for example when the threaded cap and tube are screwed together. In this embodiment, the location of threads 25 is shown. The view along the A-A direction of FIG. 4B is shown in the sectional view of FIG. 5A.

Figure 5A:
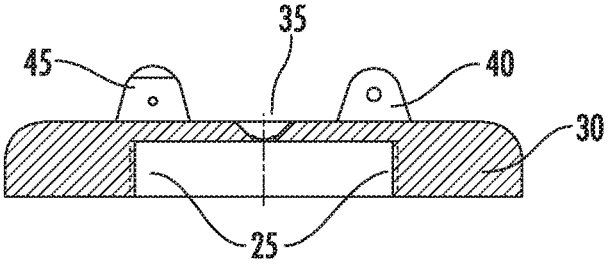
FIG. 5A illustrates a sectional view of a representative embodiment of an end cap adapted for use with a launcher tube of a handheld payload launcher system according to this disclosure.
Figure 5B:
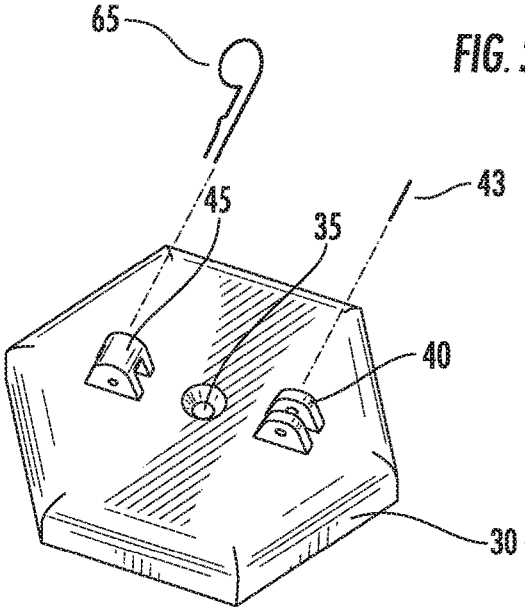
FIG. 5B illustrates a perspective view of the end cap illustrated in FIG. 5A. Also illustrated is a cotter key type safety pin.
Figure 5C:
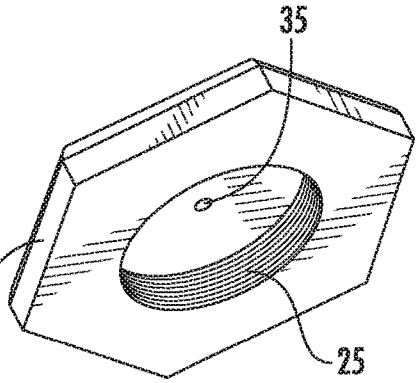
FIG. 5C illustrates a perspective view of the end cap illustrated in FIG. 5A.

FIG. 5A shows a sectional view of the cap 30, whereas FIGS. 5B and 5C show perspective views of the cap 30. Thus, FIGS. 5A-5C illustrate merely a representative embodiment of a cap 30 that can be used in a handheld payload launcher system. The cap 30 is shown with its firing pin opening 35, the hinge 40 on the cap adapted to receive the hinge portion 55 of the firing pin (not shown in this figure) and which is secured to the cap hinge 40 by a hinge pin 43. Also shown is the closed top safety pin receptacle 45 on the cap, adapted to receive the firing pin 50 and to retain the safety arm 60 of the firing pin. FIG. 5C illustrates the threads 25 that correspond to threads on the aft end of the launcher tube 10.

Figure 6A:
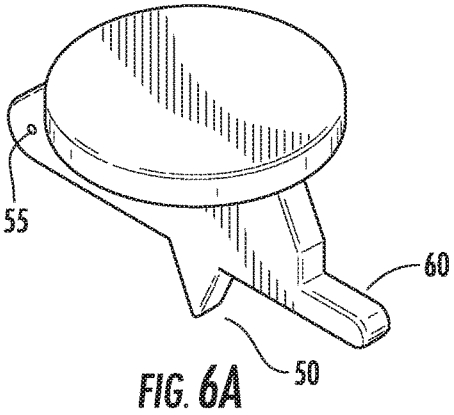
FIG. 6A illustrates perspective view of a representative embodiment of a firing pin with its component features, adapted for use with an end cap and launcher tube of a handheld payload launcher system according to this disclosure.
Figure 6B:
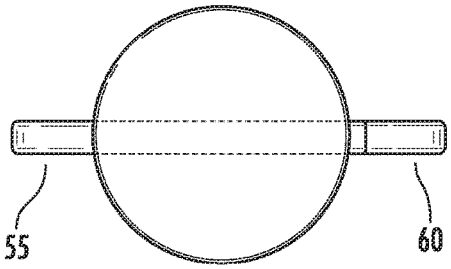
FIG. 6B illustrates an elevational view of the firing pin illustrated in FIG. 6A.
Figure 6C:
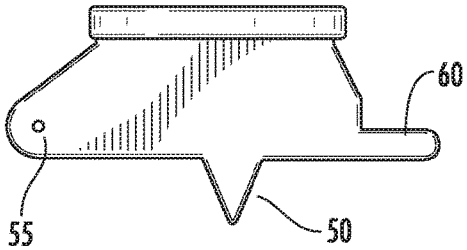
FIG. 6C illustrates an elevational view of the firing pin illustrated in FIG. 6A.

FIGS. 6A-6C provide views of an embodiment of the firing pin of this disclosure. Specifically, FIG. 6A illustrates a perspective view and FIGS. 6B-6C illustrate elevational views of a representative aspect of a handheld payload launcher system, showing the firing pin 50 with its hinge portion 55 adapted to receive a hinge pin 43 (not shown in this figure) as it mates with the hinge 40 on the cap 30, its safety arm 60, adapted to fit under the closed top safety pin receptacle 45 on the cap and to be used with a safety pin 65 (not shown in this figure).

Figure 7:
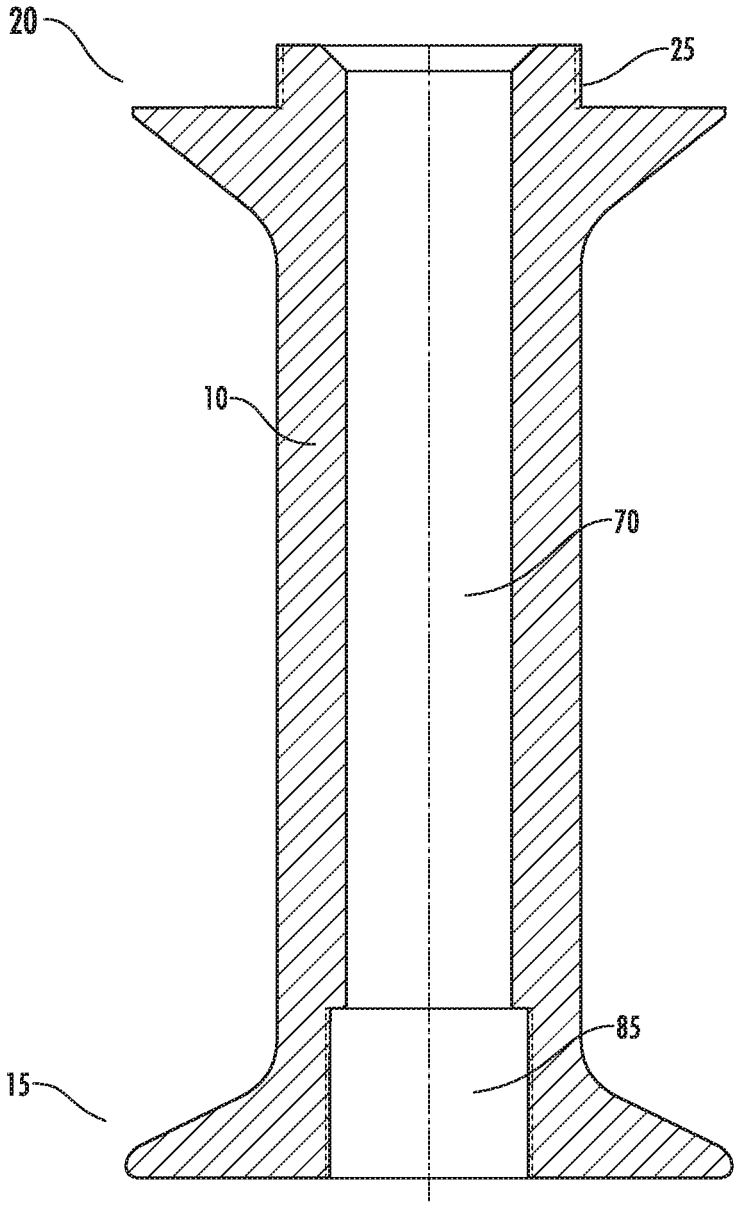
FIG. 7 provides a sectional view of a representative embodiment of a launcher tube adapted for use with a self-contained cartridge according to this disclosure.

FIG. 7 provides a sectional view of a representative aspect of a handheld payload launcher system 5 with its nozzle end 15 and aft end 20, and illustrating the launcher tube with a single chamber 70 adapted for use with a self-contained cartridge. The embodiment illustrated in FIG. 7 includes a nozzle receiving area 85 at the nozzle end 15 of the launcher tube 10, that is adapted for a choke or nozzle to be attached such as, for example, a threaded piece that is screwed into a threaded nozzle end. Use of a nozzle is optional in the launcher system, because there are applications for which very dispersed patterns are desired such that no focusing of the payload is desired.

Figure 8B:
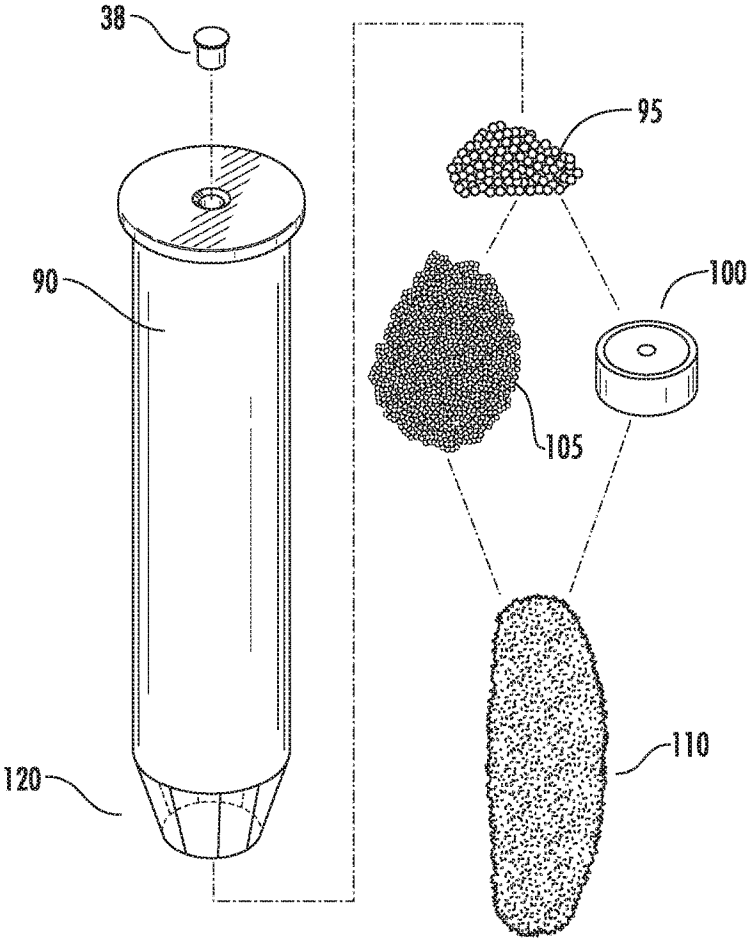
FIG. 8B is a perspective view of a representative embodiment of a self-contained cartridge for use with the launcher tube illustrated in FIG. 8A according to this disclosure. Also illustrated are the components of an exemplary self-contained cartridge, including the primer, propellant, an obturating component which can be either a granular obturating medium or a pre-shaped gas seal, and a payload such as a powder or gel payload.
Figure 8A:
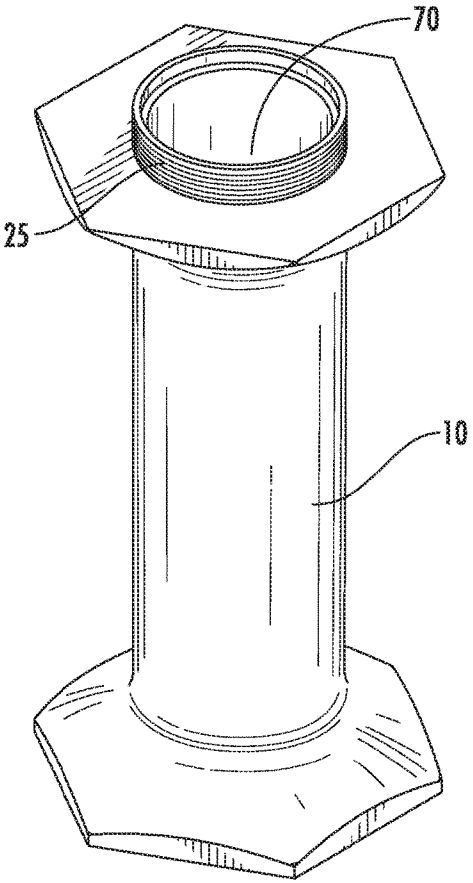
FIG. 8A is a perspective view of a representative embodiment of a launcher tube with a single chamber adapted for use with a self-contained cartridge according to this disclosure.

FIGS. 8A and 8B provide perspective views of a representative embodiment of a handheld payload launcher system 5 of this disclosure. Specifically, the embodiment illustrated in FIG. 8A includes a single chamber 70 adapted for use with a self-contained cartridge 90 having a primer 38, a propellant 95, a payload 110, and a cartridge nozzle 120 shown in FIG. 8B. The propellant 95 and payload 110 can be separated by a preformed gas seal 100 or obturating component 105 such as the "wadless" material shown in FIG. 8B if desired. Illustrated are launcher tube 10, the aft end 20, and threads 25 at the aft end adapted to receive the cap 10, such as shown in FIGS. 5A-5C, wherein the cap will be fitted with a firing pin, such as shown in FIGS. 6A-6C. The launcher embodiment of FIGS. 8A and 8B illustrate the launcher tube with a single chamber 70 contrasts with the embodiment in FIGS. 1A and 1B that includes sub-chambers. Thus, FIGS. 8A and 8B correspond to the embodiment illustrated in FIG. 7.

The FIG. 8B illustration demonstrates the utility of the self-contained cartridge 90 having a cartridge nozzle 120, because such a cartridge could be used other launcher designs in addition to the handheld launcher as disclosed herein. For example, a wide range of launcher designs can be envisioned that can be used to activate the primer of the self-contained cartridge 90 with some firing pin design or other design, in which striking the firing pin or cartridge activation mechanism with or on any object with sufficient force to ignite the primer offsets at least a portion of the recoil resulting from launching the payload. Further, the self-contained cartridge 90 of FIG. 8B can also be used without a launcher. For example, the self-contained cartridge can be grasped by an operator and can be struck with a solid object capable of indenting the firing pin, such as a bullet tip, a nail, a knife, a screwdriver and the like, which can activate the primer and launch the payload. Activation of the cartridge primer in this manner, whether contained within a launcher or not, provides a means to achieve recoil management or recoil reduction.

Also related to FIG. 8B, this disclosure provides for a self-contained cartridge in which the propulsion of the payload is provided by activation of the primer, in the absence of another propellant. That is, primers of a suitable size and type can provide sufficient expansion of gases to launch payloads, particular at shorter distances and having smaller loads. In this aspect, some self-contained cartridges 90 such as shown in FIG. 8B can have a primer 38, but be lacking a separate propellant shown at 95. The payload 110 can be, but is not required, to be separated from the primer by an obturating component such as, for example, a preformed gas seal 100 or obturating component 105 like the "wadless" material shown in FIG. 8B. Therefore, in an aspect, this disclosure provides for a self-contained cartridge comprising:

a) a cartridge case having a forward end and an aft end, wherein the forward end has a closed configuration and an open configuration and the closed configuration;

b) a primer situated at the aft end of the cartridge case; and c) a payload;

wherein the open configuration comprises a tapered nozzle formed when the cartridge opens during launching of the payload, and the diameter of the nozzle opening is less than the inner diameter of the cartridge case. In this aspect, the self-contained cartridge can optionally further comprise a propellant adjacent the primer and can optionally further comprise an obturating component adjacent the payload, between the payload and the primer or propellant.

The self-contained cartridges according to this disclosure is not limited to any particular size, diameter, or length, and these cartridges can be used in larger launchers as well as in the handheld launchers such as described herein. For example, cartridges that form a tapered nozzle that forms when the cartridge opens during payload launching also can be used in shoulder-mounted launchers. These larger cartridge launchers include those having a recoil-attenuating design such as disclosed in U.S. Pat. No. 8,807,004 to this Applicant, and those that do not have a recoil-attenuating design. For larger launchers having no particular recoil-attenuating design, recoil can be at least partially offset in the same manner as described for the handheld launcher of this disclosure. That is, recoil can be partially offset by the momentum created when the entire launcher unit is moved forward when struck with an object or by striking the aft end of the larger launcher against the substantially immovable object such as a wall, a tree, or a vehicle.

In the various embodiments of this disclosure, a hinge on the cap 40 is provided that is adapted to receive the hinge portion of the firing pin 55 and a hinge pin 43, which connects these two components. In this manner, the firing pin 50 remains connected with the cap 30 and the firing pin can rotate relative to the cap about a fixed axis of rotation, through a small arc. Typically, the hinge has a very limited angle of rotation between the firing pin and the cap, due to the closed top safety pin receptacle 45 on the cap which limits and retains the safety arm 60 of the firing pin. While a rotatably connected firing pin is illustrated, any method of mounting the firing pin to the cap such that it is movably connected and securable to achieve the functions shown are envisioned.

In this aspect, the payload launcher system includes a safety system comprising a safety pin 65 that extends through the safety pin receptacle 45 on the cap 30, and blocks the safety arm 60 of firing pin in its hinged orientation from forward motion, such that contact of the firing pin with the primer is prevented. Therefore, prior to use, the safety arm 60 is locked between the closed top of the safety pin receptacle 45 on the cap on aft side and the safety pin itself on the cap (forward) side, until such time the pin is removed. By way of example, the safety pin 65 can be similar to that found on any common fire extinguisher that must be pulled out to "arm" the device. Once the pin is pulled, the disclosed launcher requires only a sharp "rap" with either some object or the heel of the free hand to fire. For example, the firing pin (aft) end of the entire device can be slammed against a wall or other immovable surface, while holding the muzzle (fore) end pointing in the direction that payload is desired to be launched. This handheld manipulation is facilitated by the flared muzzle (fore) end and flared firing pin (aft) end, which allows striking the firing pin with or on any object with sufficient force to ignite the primer to launch the payload, while protecting the hand that is holding the launcher itself.

According to a further aspect, the handheld launcher system of this disclosure can be provided with additional features or structures as desired, to take full advantage of its utility as a self-contained cartridge. For example, the nozzle end 15 of the launcher tube 10 can provide the functions of a standard barrel from which a payload might conventionally be launched. In this aspect, the nozzle end 15 of the payload cartridge could contain, comprise, or could be made of a material that is shaped in a manner to form a nozzle 115 or "choke" upon launching, which can force a particular or desired pattern of the ejected payload. Also by way of example, the material used to construct the nozzle end portion of the cartridge itself could be selected according to thickness, shape, stiffness, composition, crimp structure, and the like, such that it conforms to a desired nozzle shape 120 when opened during launching the payload. Therefore, there are multiple ways to provide the nozzle function when desired, including with the end portion of the cartridge itself, with the shape of the nozzle end 15, or by way of an attached component such as a threaded piece that is attached at the nozzle receiving area 85, for example by being screwed into a threaded nozzle receiving area 85.

The payload cartridge that includes a material that forms a nozzle 115 or "choke" upon launching the payload can be particularly useful. This feature is provided by the combination of the material used to construct the nozzle end portion of the cartridge itself and the low muzzle velocities of the payload, for example, about 400 ft/s (feet per second) or less. For example, the material used to construct the nozzle end portion of the cartridge itself, can be selected according to thickness, shape, stiffness, composition, crimp structure, and the like, such that it conforms to a desired tapered nozzle shape 120 when opened during launching the payload at the desired velocities. The closure or closed configuration of the unfired cartridge can comprise a crimp of some type, such as a star crimp or a roll crimp. Either crimp structure can be constructed to form a tapered nozzle.

The formation of the forward end of the cartridge case into a tapered nozzle upon launching the payload is different from any conventional shotshell or cartridge. A conventional shotshell launches its payload at about 1,000-1,200 ft/sec (feet per second) for standard shotshell loads. During launching, the cartridge forward end does not form a nozzle because the high velocities and energies of the launched payload are such that complete opening of the crimped forward end of the cartridge occurs. Moreover, when most shotshell cartridge case materials are crimped at the forward end, the cartridge case materials have insufficient stiffness and rigidity to prevent complete opening at the launched velocities. That is, during launching, hot expanding gases and ejecta exit the cartridge case with sufficient energy that the portion of the cartridge case that previously formed the crimp will be forced to lie completely flush or flat against the chamber wall. In this configuration during launching, the open cartridge case does not taper or narrow and does not offer any resistance or impart any ability to concentrate or focus the payload in any manner.

This complete-opening feature of a conventional shotshell is demonstrated by examining a paper hull shotshell cartridge after firing, which exhibits evidence of what occurred during firing. The previously-crimped forward end of a paper cartridge case completely opens during launching and remains in this configuration after opening. That is, paper hull cartridges do not exhibit a material memory effect as a result of the crimp. The crimped forward end of a plastic hull shotshell cartridge also completely opens during launching of a payload from the standard velocity shotshell cartridge. Payload launching occurs with tremendous force and at a rapid rate, destroying any semblance of a crimp or nozzle shape, and resulting in a cartridge case has a completely open forward end. Some plastic hull cartridges exhibit what may be referred to as a material "memory" effect at the crimp in which, after being completely opened during firing, a slow and partial closing or constriction of the open end of the cartridge case ensues. The extent of the memory effect and even the rate at which this partial closing of the cartridge case occurs varies as a function of hull thickness and stiffness, hull polymer properties, and so forth. However, this post-firing artifact does not signify what occurred during firing and therefore during launching of the payload.

While not intending to be bound by theoretical limitations, it has been discovered by designing and tailoring the cartridge and payload combination for muzzle velocities substantially slower than used in standard shotshell loads, that is, using muzzle velocities of about 400 ft/sec or slower, a system and cartridge has been developed that allows a nozzle to form from the cartridge case during launching of the payload. The portion of the cartridge case that previously formed the crimp does not lie open completely during launching, but instead, the cartridge case opens partially during launching, and the open case retains some constriction at the opening. The case itself provides the ability to focus and concentrate payloads such as powders, liquids, and gels, in a manner that allows them to be projected to useful distances. As a result, and unlike a standard shotshell, my cartridge does not require a fully supported chamber to function property in the same manner that a standard shotshell does.

Therefore, one aspect of the disclosure provides a cartridge case having a forward end and an aft end, wherein the forward end has a closed configuration and an open configuration, and wherein the open configuration comprises a tapered nozzle formed when the cartridge opens during launching of the payload. Specifically, the diameter of the tapered nozzle that forms during launching of the payload is less than the inner diameter of the cartridge case. Referring to FIG. 8A and FIG. 8B, when the cartridge case forms a tapered nozzle in its open configuration, rather than fitting the launcher tube with a nozzle, the end of the crimped cartridge generally is flush with, or extends beyond, the open muzzle end of the launcher tube, so that the launcher tube does not interfere with the opening of the cartridge case upon firing to form the tapered nozzle to direct or focus the payload.

In another aspect, the launcher tube can be fitted with a nozzle end, rather than the cartridge case. For example, the nozzle end 15 of launcher tube 10 can be designed to have a threaded tube inserted, made of a flexible material such as plastic or paper, in which the threaded tube can be crimped either with a "pie-type" or star crimp similar to the common shotshell crimp, or with a roll crimp, which provides a method of sealing the tube to impart waterproof features. Such a structure could have a significant taper inside the tube if needed. In this manner, a true nozzle or "choke" taper can be included in the final handheld launcher that is factory-loaded. This structure could serve to focus a stream of the payload such as a dry powder over a greater distance than is possible when simply launching it out of a "cylinder" bore with little or no taper. The specific features of this structure are a function of the desired performance parameters, such as the desired distance and dispersion of payload, all of which can be adjusted by the structure, material, crimp properties, and the like, as disclosed herein. Alternatively, such crimp structures can be built into the forward end of the cartridge case, which also can focus the stream of the payload.

In a further aspect and in alternative embodiments, it is not necessary to use a priming composition and propellant to launch the desired payload. Thus, the launcher system can comprise various propellant means of providing rapid forward movement, propulsion, or launching of the payload other than a standard propellant. For example, propulsion means can include methods of providing rapidly expanding gas in the aft end of the launcher tube, a system of springs, a compressed gas source, and the like. In some embodiments, propulsion can be provided by a compressed gas, such as would be available with a gas cylinder, including a $CO_2$ (carbon dioxide) cylinder or cartridge. In this aspect, a cartridge valve that meters a blast of gas can provide propulsion, or a gas cartridge that can be pierced by penetrating contact with a sharp piercing structure can provide a blast of propelling gas. Any variety of propulsion means to provide a launching mechanism are envisioned by this disclosure.

Thus, according to aspects of this disclosure, there is provided a payload launcher system, the system comprising:

a) a launcher tube having an open nozzle end and an aft end;

b) a cap removably-attached to the aft end, the cap comprising a firing pin opening and a forward- and rearward-movable firing pin, wherein the firing pin protrudes through the firing pin opening in its forward-most position; and c) a chamber within the launcher tube adjacent the firing pin opening, the chamber adapted for receiving at least one self-contained cartridge or cartridge components, wherein the self-contained cartridge or cartridge components comprise(s) a primer and a payload, and wherein the primer is positioned within the chamber adjacent the firing pin opening.

This payload launcher system can further comprise a removable safety pin which prevents the firing pin from protruding through the firing pin opening until the safety pin is removed. According to further aspects and embodiments of this payload launcher system, a) the firing pin comprising a hinge portion and a safety arm portion;

b) the cap further comprises a hinge one on side of the firing pin opening and a safety pin receptacle on the opposite side of the firing pin opening;

c) the hinge portion of the firing pin is rotatably attached to the cap at the hinge with a hinge pin, and d) the safety arm portion of the firing pin is retained within the safety pin receptacle of the cap and prevented from moving to its forwardmost position by a removable safety pin.

The payload launcher system can further comprise an adjustable or interchangeable nozzle that allows a desired payload pattern or spread to be selected. For example, a shotgun-style choke system can be employed in which choke tubes can be used to focus the payload delivery as desired, and such tubes can be interchanged among those offering tight patterns, to those providing more wide spread patterns, to a continuous range of patterns in between the tight and wide spread patterns. Although not illustrated in the figures, the nozzle end of the launcher tube can include a nozzle receiving area as a means to attach and secure a choke or nozzle, such as threads, that have corresponding threads on the choke or interchangeable nozzle. Moreover, a shotgun-style adjustable choke system can be used similarly that does not require interchanging chokes.

A further aspect is that the payload launcher system comprises a chamber that can be shaped to receiving any type of cartridge system, because regardless of the cartridge type, the launcher system includes the recoil mitigating feature and method of use. Thus, a self-contained cartridge comprising a primer, a payload, and an optional propellant beyond the primer itself can be used. Alternatively, multiple cartridge components can be used. For example, the chamber of the launcher tube can comprise a first sub-chamber within the launcher tube adjacent the firing pin opening and a second sub-chamber within the launcher tube adjacent the first sub-chamber, the first sub-chamber shaped to receive a first self-contained cartridge comprising the primer, and the second sub-chamber shaped to receive a second self-contained cartridge comprising the payload. In this multiple cartridge embodiment, the first self-contained cartridge can further comprises a propellant adjacent the primer, if desired. Moreover, the first self-contained cartridge can simply be a blank cartridge.

Gas seals can be used as needed or desired between the propellant and the payload in any embodiment. Further the gas seal can be a preformed gas seal, or can comprise an obturating medium between the propellant and the payload, wherein the self-contained cartridge or cartridge components do not include a pre-shaped gas seal.

It is emphasized that the specific embodiment illustrated in the figures is merely illustrative and not intended to be limiting. For example, in one aspect, this disclosure provides a payload launcher system, in which the system can comprise:

a) a launcher tube having a nozzle end, an aft end, and a chamber, and comprising a movably-attached firing pin situated at the aft end;

b) a propellant sub-chamber adjacent the firing pin, adapted for receiving a primer or propellant cartridge, the propellant cartridge comprising a primer and optionally further comprising a separate propellant;

c) optionally, a removable safety pin that blocks the firing pin from contacting the primer;

d) optionally, an obturating component adjacent the propellant sub-chamber within the launcher tube; and e) a payload sub-chamber adjacent the optional obturating component or adjacent the propellant sub-chamber within the launcher tube.

According to another aspect, this disclosure provides a method of using a payload launcher system, the method comprising:

a) providing a payload launcher system as disclosed in this specification;

b) optionally, removing the safety pin, should one be provided in the particular embodiment; and c) striking the firing pin with or on any object with sufficient force to ignite the primer to launch the payload.

Still another aspect of this disclosure provides a method of launching a payload, the method comprising:

a) providing a launcher tube having
   i) a nozzle end and an aft end,
   ii) a propulsion means situated toward the aft end of the launcher tube that is activated by striking a blow to the aft end of the launcher tube, and
   ii) a payload situated toward the nozzle end of the propulsion means in the launcher tube; and b) activating the propulsion means to launch the payload and at least partially offset recoil, by
   i) striking a blow to the aft end of the launcher tube, to impart forward movement and momentum to the launcher tube, or
   ii) striking the aft end of the launcher tube against a substantially immovable object.

In accordance with one aspect, the components of the launcher system of this disclosure can be fabricated from any suitable material that will resist the heat and pressure of launching, including any suitable plastic, metal, composite, polymer, or combination thereof. For lighter weight, a suitable plastic or composite material may be used. Even though the device is relatively light for carry by military troops, law enforcement and the like, it is expected that there will be only moderate recoil when the device is launched, because most payloads are expected to be launched with from below 100 ft/sec (feet-per-second) muzzle velocities, to about 300 or 400 ft/sec muzzle velocity. Generally, about 400 ft/sec is the practical upper end of the muzzle velocities according to this disclosure. However, low muzzle velocities such as, for example, about 15 ft/sec, about 25 ft/sec, about 35 ft/sec, about 45 ft/sec, about 55 ft/sec, about 65 ft/sec, about 75 ft/sec, about 85 ft/sec, or about 95 ft/sec, and the like are encompassed in embodiments of this disclosure. Generally, these velocities are all that is required, because it is expected that these devices will be most useful for launching payloads at close ranges, for example, from 15 to 40 feet in many cases.

In certain aspects, certain advantages of the disclosed handheld launcher include the ability of this design to pack and contain possibly reactive chemicals in a waterproof cartridge/launcher for safety. The launcher is specifically designed to deliver its payload at short range, with extremely high reliability, using a system that does not require constant maintenance or recharges to maintain pressure. It is also expected that it will be possible to minimize injury to personnel, should it be necessary to launch a chemical payload such as fire suppression chemicals or anti-chemical warfare substances, directly at personnel with the intent to cover the individual with the chemical payload.

Also by way of example, the present launcher system can be used to deliver any number of payload types, including but not limited to, rubber projectile payload, a bean bag payload, frangible payload, a tear gas-containing payload, an oleoresin capsicum-containing payload, a liquid-containing payload, a powder-containing payload, a gel-containing payload, a marking payload, a tracer payload, an incendiary payload, a flare payload, a chemical or chemical-containing payload, a biological or biological-containing payload, or any combination thereof.

According to another aspect, the launcher of this disclosure is not required to be handheld, and in some embodiments can be used in a fixed mount configuration for specific purposes. For example, a mounted launcher can be fitted with a heat sensing activator that triggers the propulsion means (for example, a propellant, a compressed gas, or a spring system) in case of fire, thereby spraying an area with a fire suppressant material. Such a system employs a different trigger activating method that the handheld version which employs a striking blow of some type to the firing pin.

According to one aspect, the disclosed launcher does not fall under the definitions of "destructive device" as set forth in either Title I (the Gun Control Act of 1968) or Title II (the National Firearms Act of 1934) of the Federal firearms laws. In this aspect, the launcher devices cannot be used or fired with any known ammunition. Rather, primer and propellant cartridges must be specifically manufactured for use in these launcher systems, typically using a proprietary or non-standard size. The types of payloads and cartridges that the launcher is designed to handle are not anti-personnel payloads, but rather those designed for saving lives and property, such as various chemical payloads. For example, the launcher systems of this disclosure can be used to launch cartridges that contain payloads such as dry chemicals, gels, and the like, examples of which include fire suppression chemicals, anti-chemical warfare substances that can counteract chemical warfare agents, or anti-biological warfare substances that can counteract biological warfare agents.

While not generally intended for such uses, if desired, the present launcher system can be adapted to launch other payloads that may constitute classifying the device as a destructive device, such as a non-frangible payload, a penetrator payload, a flechette payload, an armor-piercing payload, an explosive payload, and the like. Therefore, the present devices could be adapted for use with a grenade launcher cartridge, an explosive-launching cartridge, an armor-piercing cartridge, or anti-personnel cartridges.

Definitions

To define more clearly the terms used herein, the following definitions are provided, which are applicable to this disclosure unless otherwise indicated by the disclosure or the context. To the extent that any definition or usage provided by any document incorporated herein by reference conflicts with the definition or usage provided herein, the definition or usage provided herein controls.

Reference to the nozzle end, forward end, or fore end of a particular launcher, component, or cartridge means the end that is further downrange when the component or cartridge is in its intended orientation for firing. The fore end may also be termed the leading end or leading edge, the top, the downrange end, or the distal end, and these terms are used interchangeably.

Reference to the aft, rearward or rear end of a particular launcher, component, or cartridge means the end that is further uprange when the component or cartridge is in its intended orientation for firing. The rear end may also be termed trailing end or trailing edge, the aft portion or aft end, the bottom, the uprange end, the proximal end, or the primer end, and these terms are used interchangeably.

The term "nozzle" refers to the tapering vent or tapering portion of the cartridge at the end of the tubular cartridge case which directs, focuses, or accelerates the payload.

The term "tapered" refers to the fact that the diameter of the nozzle at its opening is less than the inner diameter of the cartridge case itself. This term is used to distinguish a conventional forward end of a cartridge upon opening, in which the portion of the cartridge case that previously formed the crimp lies completely flush or flat against the chamber wall upon firing. "Tapered" in used to describe the nozzle that forms upon opening, regardless of what type of crimp or closure is used to form the closed configuration of the cartridge case. For example, a star crimp may form a nozzle from a pleated-type opening upon launching the payload. In conventional shotshell, this lies completely flat against the chamber wall upon firing the cartridge, but forms a tapered nozzle in the disclosed cartridge. That is, the inner diameter of the pleated opening and the average diameter of the opening formed by the pleats are less than the inner diameter of the cartridge case itself.

Throughout this specification, various publications may be referenced. The disclosures of these publications are hereby incorporated by reference in pertinent part, in order to more fully describe the state of the art to which the disclosed subject matter pertains. The references disclosed are also individually and specifically incorporated by reference herein for the material contained in them that is discussed in the sentence in which the reference is relied upon. To the extent that any definition or usage provided by any document incorporated herein by reference conflicts with the definition or usage provided herein, the definition or usage provided herein controls.

As used in the specification and the appended claims, the singular forms "a," "an," and "the" include plural referents, unless the context clearly dictates otherwise. Thus, for example, reference to "a projectile" or "a payload" includes a single projectile such as a slug made of the desired material, as well as any combination of more than one projectile, such as multiple pellets of the material in any size or combination of sizes. Also for example, reference to "a payload" includes multiple particles of a chemical composition or mixture of compositions that constitutes a projectile in that it is launched at a target.

Throughout the specification and claims, the word "comprise" and variations of the word, such as "comprising" and "comprises," means "including but not limited to," and is not intended to exclude, for example, other additives, components, elements, or steps. While structures, compositions, and methods are described in terms of "comprising" various components or steps, the structures, compositions, and methods can also "consist essentially of" or "consist of" the various components or steps.

"Optional" or "optionally" means that the subsequently described element, component, step, or circumstance can or cannot occur, and that the description includes instances where the element, component, step, or circumstance occurs and instances where it does not.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed herein, and that each value is also herein disclosed as "about" that particular value in addition to the value itself. In aspects, "about" can be used to mean within 10% of the recited value, within 5% of the recited value, within 2% of the recited value, or within 1% of the recited value.

In any application before the United States Patent and Trademark Office, the Abstract of this application is provided for the purpose of satisfying the requirements of 37 C.F.R. § 1.72 and the purpose stated in 37 C.F.R. § 1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

Those skilled in the art will readily appreciate that modifications are possible in the exemplary embodiments disclosed herein without materially departing from the novel teachings and advantages according to this disclosure. Accordingly, all such modifications and equivalents are intended to be included within the scope of this disclosure as defined in the following claims. Therefore, it is to be understood that resort can be had to various other aspects, embodiments, modifications, and equivalents thereof which, after reading the description herein, may suggest themselves to one of ordinary skill in the art without departing from the spirit of the present disclosure or the scope of the appended claims.

What is claimed is:

1. A self-contained cartridge comprising:

a) a cartridge case having a forward end and an aft end and a uniform diameter extending from the forward end to the aft end, wherein the forward end has a closed configuration and an open configuration;

b) a primer situated at the aft end of the cartridge case;

c) a propellant adjacent the primer; and d) a payload;

wherein the open configuration of the forward end comprises a tapered nozzle formed from the cartridge case when the cartridge opens during launching of the payload, and the diameter of the nozzle opening is less than the inner diameter of the cartridge case, and wherein the forward end of the cartridge case which forms the tapered nozzle is crimped in the closed configuration;

wherein the nozzle is configured to force a desired pattern of the payload; and wherein the tapered nozzle of the open configuration forms in the absence of a nozzle-shaped chamber.

2. A self-contained cartridge according to claim 1, further comprising an obturating component between the propellant and the payload.

3. A self-contained cartridge according to claim 2, wherein the obturating component is a granular obturating medium or a pre-shaped gas seal.

4. A self-contained cartridge according to claim 1, further comprising a granular obturating medium between the propellant and the payload, wherein the self-contained cartridge does not include a pre-shaped gas seal.

5. A self-contained cartridge according to claim 1, wherein the payload is selected from chemical, powder, gel, fire suppression, pyrotechnic, marker, tracer, signaling, explosive, smoke, incendiary, biological, heat insulating, anti-chemical warfare, anti-biological warfare, liquid-containing, powder-containing, or gel-containing payloads.

6. A self-contained cartridge according to claim 1, wherein the self-contained cartridge is selected from a flare cartridge, a smoke cartridge, a smoke flare cartridge, a signaling device cartridge, a chemical cartridge, a biological cartridge, a distraction device cartridge, a pyrotechnic cartridge, a marking cartridge, an incendiary cartridge, a tracer cartridge, an anti-chemical warfare cartridge, or an anti-biological warfare cartridge.

7. A self-contained cartridge according to claim 1, wherein the closed configuration of the forward end of the cartridge case comprises a star crimp or a roll crimp.

8. A self-contained cartridge according to claim 1, wherein the tapered nozzle forms when the cartridge opens during launching of the payload at less than or about 400 ft/sec.

9. A method of launching a payload, the method comprising:

a1) providing self-contained cartridge according to claim 1; and b) striking the primer with or on any object with sufficient force to activate the primer and to offset at least a portion of the recoil resulting from launching the payload.

10. A method of launching a payload according to claim 9, the method further comprising:

a2) providing a payload launcher system comprising:

i) a launcher tube having an open nozzle end and an aft end;

ii) a cap removably-attached to the aft end, the cap comprising a firing pin opening and a forward- and rearward-movable firing pin, wherein the firing pin protrudes through the firing pin opening in its forwardmost position; and iii) a chamber within the launcher tube adjacent the firing pin opening adapted for receiving the self-contained cartridge; and a3) inserting the self-contained cartridge in the chamber and attaching the cap to the aft end of the launcher tube;

wherein the step of striking the primer comprises striking the firing pin with or on any object with sufficient force to activate the primer and to offset at least a portion of the recoil resulting from launching the payload.

11. A method of launching a payload according to claim 9, wherein the payload is launched with a muzzle velocity of less than or about 400 ft/sec.

12. A method of launching a payload according to claim 9, wherein the self-contained cartridge further comprises an obturating component between the propellant and the payload.

13. A method of launching a payload according to claim 9, wherein the payload is selected from chemical, powder, gel, fire suppression, pyrotechnic, marker, tracer, signaling, explosive, smoke, incendiary, biological, heat insulating, anti-chemical warfare, anti-biological warfare, liquid-containing, powder-containing, or gel-containing payloads.

14. A method of launching a payload according to claim 9, wherein the self-contained cartridge is selected from a flare cartridge, a smoke cartridge, a smoke flare cartridge, a signaling device cartridge, a chemical cartridge, a biological cartridge, a distraction device cartridge, a pyrotechnic cartridge, a marking cartridge, an incendiary cartridge, a tracer cartridge, an anti-chemical warfare cartridge, or an anti-biological warfare cartridge.

15. A self-contained cartridge comprising:

a) a cartridge case having a forward end and an aft end and a uniform diameter extending from the forward end to the aft end, wherein the forward end has a closed configuration and an open configuration;

b) a primer situated at the aft end of the cartridge case; and c) a payload;

wherein the open configuration of the forward end comprises a tapered nozzle formed from the cartridge case when the cartridge opens during launching of the payload, and the diameter of the nozzle opening is less than the inner diameter of the cartridge case, and wherein the forward end of the cartridge case which forms the tapered nozzle is crimped in the closed configuration;

wherein the nozzle is configured to force a desired pattern of the payload; and wherein the tapered nozzle of the open configuration forms in the absence of a nozzle-shaped chamber.

16. A self-contained cartridge according to claim 15, further comprising an obturating component between the primer and the payload.

17. A self-contained cartridge according to claim 16, wherein the obturating component is a granular obturating medium or a pre-shaped gas seal.

18. A self-contained cartridge according to claim 15, further comprising a granular obturating medium between the primer and the payload, wherein the self-contained cartridge does not include a pre-shaped gas seal.

19. A self-contained cartridge according to claim 15, further comprising a propellant between the primer and the payload.

20. A self-contained cartridge according to claim 15, wherein the closed configuration of the forward end of the cartridge case comprises a star crimp or a roll crimp.

21. A self-contained cartridge according to claim 15, wherein the payload is selected from chemical, powder, gel, fire suppression, pyrotechnic, marker, tracer, signaling, explosive, smoke, incendiary, biological, heat insulating, anti-chemical warfare, anti-biological warfare, liquid-containing, powder-containing, or gel-containing payloads.

22. A self-contained cartridge according to claim 15, wherein the self-contained cartridge is selected from a flare cartridge, a smoke cartridge, a smoke flare cartridge, a signaling device cartridge, a chemical cartridge, a biological cartridge, a distraction device cartridge, a pyrotechnic cartridge, a marking cartridge, an incendiary cartridge, a tracer cartridge, an anti-chemical warfare cartridge, or an anti-biological warfare cartridge.

* * * * *